US006145154A

United States Patent [19]

Blair

[11] Patent Number: 6,145,154

[45] Date of Patent: Nov. 14, 2000

[54] PERSONAL HYGIENE DEVICE

[76] Inventor: Josephine Blair, 728 S. Alden St., Philadelphia, Pa. 19143

[21] Appl. No.: 09/311,407

[22] Filed: May 13, 1999

[51] Int. Cl.[7] ..... A47K 7/08

[52] U.S. Cl. ..... 15/210.1; 15/143.1; 15/144.4; 15/147.1; 15/209.1; 15/244.1; 294/19.1; 604/1

[58] Field of Search ..... 15/143.1, 144.1, 15/144.4, 145, 147.1, 150, 209.1, 210.1, 244.1; 604/1; 294/19.1; 16/421, 430, 429

[56] References Cited

U.S. PATENT DOCUMENTS

| | | | |
|---|---|---|---|
| D. 393,514 | 4/1998 | Haldey et al. | 16/421 X |
| 867,080 | 9/1907 | Rife | 15/244.1 |
| 929,860 | 8/1909 | Keith | 15/244.1 |
| 1,289,325 | 12/1918 | Wake | 15/210.1 X |
| 1,558,225 | 10/1925 | Boeker | 15/210.1 X |
| 1,631,791 | 6/1927 | Buckley | 15/210.1 X |
| 1,783,151 | 11/1930 | McArthur | 15/244.1 |
| 2,146,290 | 2/1939 | Doyle | 15/210.1 X |
| 2,294,186 | 8/1942 | Kirschbaum | 604/1 |
| 2,590,614 | 3/1952 | Hawkins, Sr. | 15/244.1 X |
| 2,666,224 | 1/1954 | Adams | 15/210.1 X |
| 4,031,673 | 6/1977 | Hagelberg | 15/210.1 X |
| 4,475,836 | 10/1984 | Colognori | 15/244.1 X |
| 4,809,388 | 3/1989 | Dietrich | 15/143.1 S |
| 4,987,634 | 1/1991 | Weihrauch | 15/209.1 |
| 5,435,039 | 7/1995 | Taylor | 15/210.1 |
| 5,630,243 | 5/1997 | Federico et al. | 15/210.1 X |
| 5,823,592 | 10/1998 | Kalidindi | 15/210.1 X |

FOREIGN PATENT DOCUMENTS

| | | | |
|---|---|---|---|
| 231213 | 7/1959 | Australia | 15/210.1 |
| 230614 | 3/1925 | United Kingdom | 15/244.1 |
| 1340949 | 12/1973 | United Kingdom | 15/244.1 |

*Primary Examiner*—Mark Spisich

[57] ABSTRACT

A personal hygiene device for holding tissue or cloth for wiping and washing parts of the body that may be hard or impossible to reach due to a physical disabiliity. The personal hygiene device includes a first tube, a second tube telescopically extending from the first tube, and a clamping portion coupled to a free end of the second tube. The clamping portion is adapted for holding a tissue or cloth for wiping a body part.

13 Claims, 1 Drawing Sheet

PERSONAL HYGIENE DEVICE

BACKGROUND OF THE INVENTION

1. Field of the Invention

The present invention relates to hygiene devices and more particularly pertains to a new personal hygiene device for holding tissue or cloth for wiping and washing parts of the body that may be hard or impossible to reach due to a physical disabiliity.

2. Description of the Prior Art

The use of hygiene devices is known in the prior art. More specifically, hygiene devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,864,110; U.S. Pat. No. 1,441,067; U.S. Pat. No. 1,487,213; U.S. Pat. No. 4,642,832; U.S. Pat. No. 5,333,344; and U.S. Pat. No. Des. 304,630.

While these devices fulfill their respective, particular objectives and requirements, the aforementioned patents do not disclose a new personal hygiene device. The inventive device includes a first tube, a second tube telescopically extending from the first tube, and a clamping portion coupled to a free end of the second tube, the clamping portion is adapted for holding a wiping means such as a tissue or cloth for wiping a body part.

In these respects, the personal hygiene device according to the present invention substantially departs from the conventional concepts and designs of the prior art, and in so doing provides an apparatus primarily developed for the purpose of holding tissue or cloth for wiping and washing parts of the body that may be hard or impossible to reach due to a physical disabiliity.

SUMMARY OF THE INVENTION

In view of the foregoing disadvantages inherent in the known types of hygiene devices now present in the prior art, the present invention provides a new personal hygiene device construction wherein the same can be utilized for holding tissue or cloth for wiping and washing parts of the body that may be hard or impossible to reach due to a physical disabiliity.

The general purpose of the present invention, which will be described subsequently in greater detail, is to provide a new personal hygiene device apparatus and method which has many of the advantages of the hygiene devices mentioned heretofore and many novel features that result in a new personal hygiene device which is not anticipated, rendered obvious, suggested, or even implied by any of the prior art hygiene devices, either alone or in any combination thereof.

To attain this, the present invention generally comprises a first tube, a second tube telescopically extending from the first tube, and a clamping portion coupled to a free end of the second tube, the clamping portion is adapted for holding a wiping means such as a tissue or cloth for wiping a body part.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new personal hygiene device apparatus and method which has many of the advantages of the hygiene devices mentioned heretofore and many novel features that result in a new personal hygiene device which is not anticipated, rendered obvious, suggested, or even implied by any of the prior art hygiene devices, either alone or in any combination thereof.

It is another object of the present invention to provide a new personal hygiene device which may be easily and efficiently manufactured and marketed.

It is a further object of the present invention to provide a new personal hygiene device which is of a durable and reliable construction.

An even further object of the present invention is to provide a new personal hygiene device which is susceptible of a low cost of manufacture with regard to both materials and labor, and which accordingly is then susceptible of low prices of sale to the consuming public, thereby making such personal hygiene device economically available to the buying public.

Still yet another object of the present invention is to provide a new personal hygiene device which provides in the apparatuses and methods of the prior art some of the advantages thereof, while simultaneously overcoming some of the disadvantages normally associated therewith.

Still another object of the present invention is to provide a new personal hygiene device for holding tissue or cloth for wiping and washing parts of the body that may be hard or impossible to reach due to a physical disabiliity.

Yet another object of the present invention is to provide a new personal hygiene device which includes a first tube, a second tube telescopically extending from the first tube, and a clamping portion coupled to a free end of the second tube, the clamping portion is adapted for holding a wiping means such as a tissue or cloth for wiping a body part.

Still yet another object of the present invention is to provide a new personal hygiene device that is particularly useful for persons who are permanently or temporarily handicapped due to injury to the hands, wrists, arms, shoulders, back, or other body part.

Even still another object of the present invention is to provide a new personal hygiene device that is also particularly useful for overweight persons who have trouble reaching their private parts.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
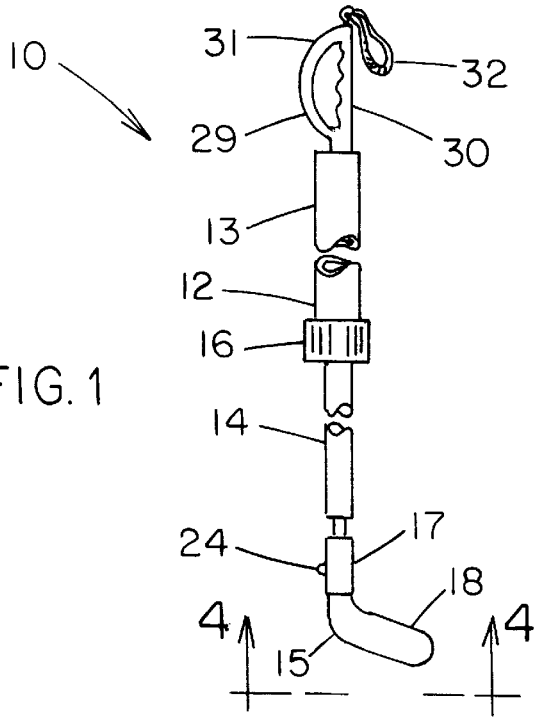
FIG. 1 is a schematic side view of a new personal hygiene device according to the present invention.
Figure 3:
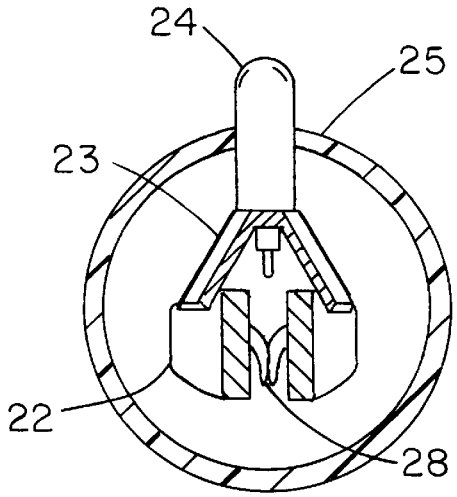
FIG. 3 is a schematic detailed view of the present invention taken from line 3—3 of FIG. 2.
Figure 2:
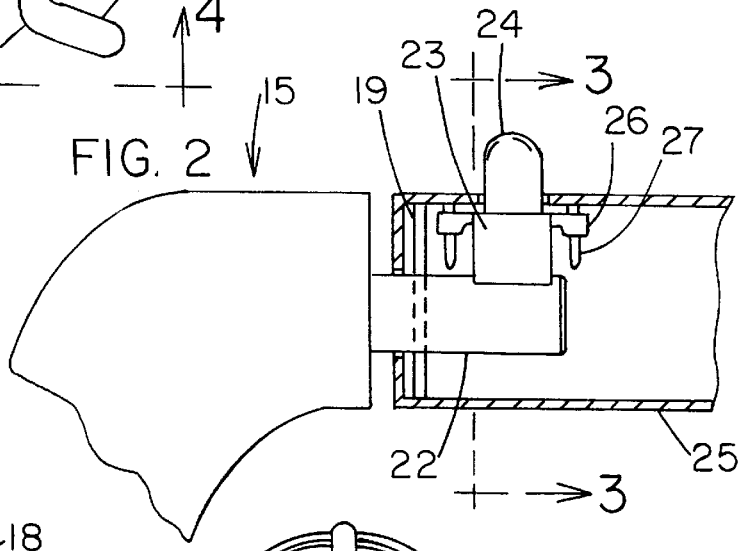
FIG. 2 is a schematic breakaway view of the present invention.
Figure 4:
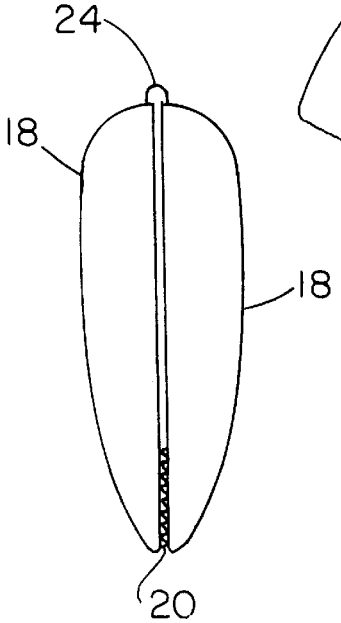
FIG. 4 is a schematic detailed view of the clamping portion of the present invention taken from line 4—4 of FIG. 1.
Figure 5:
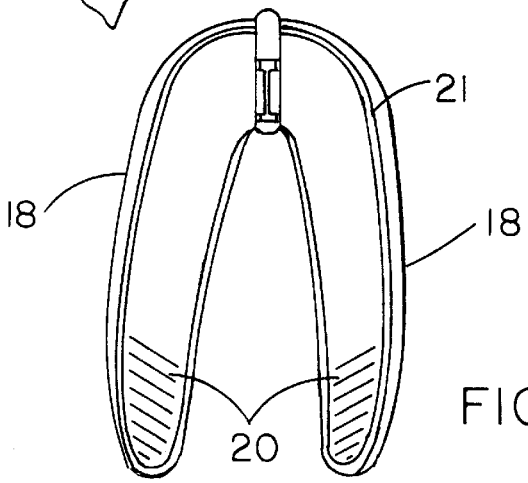
FIG. 5 is a schematic detailed view of the clamping portion of the present invention in an open orientation.

With reference now to the drawings, and in particular to FIGS. 1 through 5 thereof, a new personal hygiene device embodying the principles and concepts of the present invention and generally designated by the reference numeral 10 will be described.

As best illustrated in FIGS. 1 through 5, the personal hygiene device 10 generally comprises a shaft 12 having a first tube 13 and a second tube 14 telescopically extending from the first tube. A clamping portion 15 is coupled to a free end of the second tube. The clamping portion is adapted for holding a wiping means such as a tissue or cloth for wiping a body part.

Preferably, a locking means 16 prevents sliding of the second tube with respect to the first tube. Any suitable locking means known in the art may be used.

Also preferably, the clamping portion has a main portion 17 and a pair of clamping arms 18 pivotally coupled to the main portion by pins 19 such that the clamping arms may be selectively spread apart. Ideally, each of the clamping arms has a plurality of corrugations 20 on inner surfaces thereof and positioned towards free ends thereof. The corrugations prevent a cloth or tissue from sliding along the clamping arms. Also ideally, each of the clamping arms has a resiliently deformable covering 21 for safety. Most ideally, the covering comprises foam rubber because of its soft-to-the-touch properties and because it frictionally resists sliding of cloth or tissue across its surface.

Preferably, each of the clamping arms has a finger 22 extending therefrom. The fingers of the clamping portions angle away from each other from the pins towards free ends of the fingers. The main portion of the clamping portion has a generally V-shaped engaging member 23 slidably engaging the fingers of the clamping arms. Movement of the engaging member towards the fingers forces the fingers together, thereby spreading the clamping arms apart.

Ideally, the engaging member has a button 24 extending through an outer housing 25 of the main portion for pushing the engaging member towards the fingers. Also ideally, the engaging member has a pair of sleeves 26 extending therefrom and receiving a pair of guide pins 27 extending from the outer housing of the main portion for preventing pivoting of the engaging member, as opposed to linear motion, with respect to the outer housing.

A spring 28 may be disposed between the fingers of the clamping arms for biasing the fingers apart, thereby biasing the clamping arms together.

Alternative means of opening the clamping arms would include a button (not shown) positioned towards the free end of the first tube.

Preferably, the clamping portion is selectively rotatable with respect to the second tube. Ideally, the clamping portion will only rotate upon exertion of a predetermined amount of force.

Also preferably, a handle 29 is coupled to a free end of the first tube. Ideally, the handle has a corrugated grasping portion 30. Optionally, the handle may have an arcuate guard portion 31 extending from opposite ends of the grasping portion to help prevent the handle from is dropped. A hanging loop 32 may be coupled to the handle.

The preferred length of the shaft in the fully extended position is preferably between about 18 and 24 inches.

In use, the length of the shaft is adjusted to a desired length. The clamping arms are opened by pressing the button. A cloth or sponge is placed in the clamping arms and used to clean a hard to reach area of the body. The same general procedure is followed using tissue paper instead of the cloth or sponge to wipe feces from a rectal area. The button is again pushed to release the cloth, sponge, or tissue paper.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A personal hygiene device, comprising:

an elongate shaft;

a clamping portion coupled to an end of said shaft, said clamping portion being adapted for holding a wiping means for wiping a body part;

wherein said clamping portion has a main portion and a pair of clamping arms pivotally coupled to said main portion such that said clamping arms may be selectively spread apart; and wherein each of said clamping arms has a finger extending therefrom, said fingers of said clamping portions angling away from each other, said main portion of said clamping portion having a generally V-shaped engaging member slidably engaging said fingers of said clamping arms, wherein movement of said engaging member towards said fingers forces said fingers together thereby spreading said clamping arms apart.

2. The device of claim 1, wherein said shaft comprises a second tube telescopically received in a first tube.

3. The device of claim 1, wherein each of said clamping arms has a plurality of corrugations on inner surfaces thereof and positioned towards free ends thereof.

4. The device of claim 1, wherein each of said clamping arms has a resiliently deformable covering.

5. The device of claim 1, wherein said engaging member has a button extending through an outer housing of said main portion for pushing said engaging member towards said fingers.

6. The device of claim 5, wherein said engaging member has a pair of sleeves extending therefrom and receiving a pair of guide pins extending from said outer housing of said main portion for preventing pivoting of said engaging member with respect to said outer housing.

7. The device of claim 1, wherein a spring is disposed between said fingers of said clamping arms for biasing said fingers apart.

8. The device of claim 1, wherein said clamping portion is selectively rotatable with respect to said shaft.

9. The device of claim 1, further comprising a handle coupled to a free end of said shaft opposite said clamping portion.

10. The device of claim 9, wherein said handle has a corrugated grasping portion.

11. The device of claim 10, wherein said handle has an arcuate guard portion extending from opposite ends of said grasping portion.

12. The device of claim 9, further comprising a hanging loop coupled to said handle.

13. A personal hygiene device, comprising:

a first tube;

a second tube telescopically extending from said first tube;

a clamping portion coupled to a free end of said second tube, said clamping portion being adapted for holding a wiping means for wiping a body part;

a locking means for preventing sliding of said second tube with respect to said first tube;

said clamping portion having a main portion and a pair of clamping arms pivotally coupled to said main portion such that said clamping arms may be selectively spread apart;

each of said clamping arms having a plurality of corrugations on inner surfaces thereof and positioned towards free ends thereof;

each of said clamping arms having a resiliently deformable covering;

each of said clamping arms having a finger extending therefrom, said fingers of said clamping portions angling away from each other;

said main portion of said clamping portion having a generally V-shaped engaging member slidably engaging said fingers of said clamping arms, wherein movement of said engaging member towards said fingers forces said fingers together thereby spreading said clamping arms apart;

said engaging member having a button extending through an outer housing of said main portion for pushing said engaging member towards said fingers;

said engaging member having a pair of sleeves extending therefrom and receiving a pair of guide pins extending from said outer housing of said main portion for preventing pivoting of said engaging member with respect to said outer housing;

wherein a spring is disposed between said fingers of said clamping arms for biasing said fingers apart;

said clamping portion being selectively rotatable with respect to said second tube;

a handle coupled to a free end of said first tube;

said handle having a corrugated grasping portion;

said handle having an arcuate guard portion extending from opposite ends of said grasping portion; and a hanging loop coupled to said handle.

* * * * *